US005250919A

United States Patent [19]

Schedele

[11] Patent Number: 5,250,919

[45] Date of Patent: Oct. 5, 1993

[54] ELECTROMAGNETIC RELAY

[75] Inventor: Helmut Schedele, Unterer Forst, Fed. Rep. of Germany

[73] Assignee: Siemens Aktiengesellschaft, Munich, Fed. Rep. of Germany

[21] Appl. No.: 855,037

[22] PCT Filed: Nov. 16, 1989

[86] PCT No.: PCT/DE89/00722

§ 371 Date: May 6, 1992

§ 102(e) Date: May 6, 1992

[87] PCT Pub. No.: WO91/07769

PCT Pub. Date: May 30, 1991

[51] Int. Cl.[5] ..... H01H 51/22

[52] U.S. Cl. ..... 335/128; 335/78

[58] Field of Search ..... 335/78-86, 335/124, 128, 131, 133

[56] References Cited

U.S. PATENT DOCUMENTS 4,949,058 8/1990 Nishikawa et al. ..... 335/128

5,084,688 1/1992 Martino ..... 335/78

*Primary Examiner*—Lincoln Donovan

*Attorney, Agent, or Firm*—Hill, Steadman & Simpson

[57] ABSTRACT

In a relay, the magnet system is mounted in the upper zone of a cap-shaped housing, while the contact system (8) is inserted into the housing from the open underside until the contact (91, 92) closes when the magnet system is excited. After further insertion by a prescribed extra way, the contact system (8) is connected to the housing (1) without a stop at its edge (82*a*). It is therefore possible to compensate manufacturing tolerances during assembly, so that subsequent adjustment of the contact system is not required.

6 Claims, 3 Drawing Sheets

ELECTROMAGNETIC RELAY

BACKGROUND OF THE INVENTION

1. Field of the Invention

The invention relates to an electromagnetic relay having a cap-shaped housing open towards the terminal end of the relay, a magnet system with coil and armature arranged in the upper, closed zone of the housing, and a contact system which is arranged in the lower, open zone of the housing and has in a carrier of insulating material at least one moveable contact element that is operationally connected to the armature via an actuator, the carrier at least partly closing the open side of the housing from below. Moreover, the invention relates to a process for assembling such a relay.

2. Description of the Related Art

In known relays of this type, the magnet system and contact system are as a rule mutually assigned at a fixed spacing. In Germal Utility Model 85 24 259-U1, for example, the magnet system is rigidly connected via its yoke to a U-shaped body of the contact system, so that the design also fixes the positions and mutual spacings of the armature and the moveable contact elements. Manufacturing tolerances of the individual parts must thus be compensated after the connection of the magnet system and the contact system by appropriate adjustment of the contact elements and of the armature, respectively. Not until then is the entire relay system inserted into the housing cap.

In another known relay, which is described in Germal published Application 2,622,133, the magnet system is in fact glued fast to the inside of a cap-shaped housing part. However, in this case, as well, the contact system is rigidly coupled with spacings to the magnet system, since it is directly mounted via blocks of insulating material on the magnet system, that is to say the yoke. In this case, as well, special adjustment of the contacts is therefore necessary before assembly.

SUMMARY OF THE INVENTION

It is the object of invention to provide a relay having the structure mentioned at the beginning in which manufacturing tolerances can already be taken into account by the assembly of the relay, that is to say adjustment is not required as a special work operation.

According to the invention, this aim is achieved in such a relay when each moveable contact element extends essentially parallel to the terminal plane and is actuatable in a direction perpendicular thereto, the magnet system is anchored directly in the housing, and the carrier of the contact system is guided in a guideway of the housing parallel to the actuating direction without a stop and connected to the housing in a freely settable insertion position.

In the relay according to the invention the magnet system and the contact system are not mutually fixed by design and thus affected by tolerances, but the magnet system is merely rigidly anchored in the housing, while the contact system is brought to the desired spacing by the guideway in the housing while assembly is still going on, and is mounted at a position that is not strictly prescribed. Consequently, manufacturing tolerances can be eliminated during assembly. The mounting is performed, for example, by a clamped or glued joint, by ultrasonic welding, or in some other way. It is important, in any event, that the joint is not made at a strictly prescribed stop in the actuating direction.

In an advantageous embodiment, the carrier of the contact system has an essentially plate-shaped base part with a circumferential guide edge and a mounting block, integrally formed in one piece on the base part, for contact springs that can be plugged laterally into receptor slots. Moreover, towards the magnet system the carrier can have an insulating lid part integrally formed in one piece which shields the contact elements with the exception of a penetration point for the actuator. However, the invention can also be applied to a contact system in which the contact elements are embedded in the carrier or are inserted in another way.

In a process according to the invention for assembling the described relay, the magnet system is firstly anchored, for example, glued, in the body, the contact system is then inserted into the open body until the contact or contacts close when the magnet system is excited and, finally, the contact system is inserted further by a prescribed amount, preferably when the magnet system is no longer excited, in order to guarantee a specific excess stroke or a specific erosion resistance, whereupon the carrier is then finally connected to the housing.

BRIEF DESCRIPTION OF THE DRAWINGS

The invention is explained in more detail below with reference to an exemplary embodiment with the aid of the drawing, wherein.

DETAILED DESCRIPTION OF THE PREFERRED EMBODIMENTS

Figure 2:
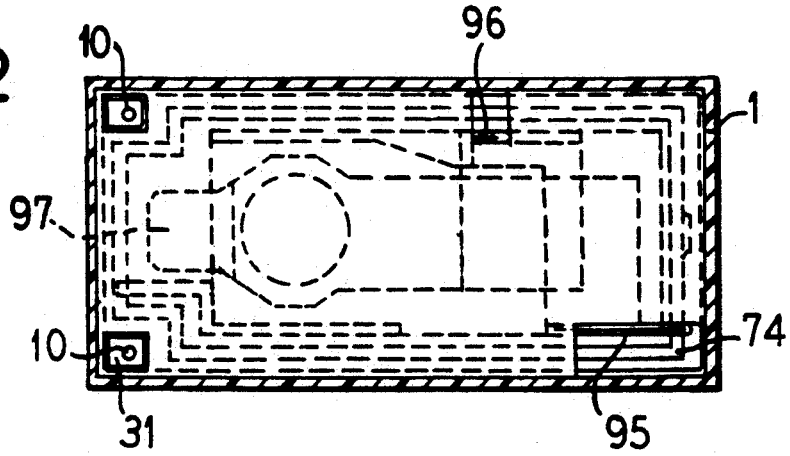
FIGS. 2 to 5 show further sectional views of the relay shown in FIG. 1.

The relay shown in FIGS. 1 to 5 has a housing 1 in the form of a protective cap whose open side points downwards, that is to say towards the installation plane of the relay. In the upper region, that is to say in the closed part of the housing 1, a magnet system is arranged consisting of a coil winding 2 on a coil former 3, a core 4 extending axially through the coil, and an angular yoke 5 which is connected by a vertically extending limb 51 to the core 4 and extends by a limb 52 extending horizontally below the coil parallel to the coil axis and to the axis of the core. The free end of the core 4 forms a pole plate 41 which is opposite an armature 6 in the form of a ferromagnetic plate. The armature 6 is connected to an actuator 7 to form a permanent armature unit. In this arrangement, the armature 6 is embedded or glued into a side wall 71 of the actuator in such a way that essentially only the pole face 61, which is opposite the core pole plate 41, is exposed. Of course, other mounting processes, such as ultrasonic welding and the like, can also be applied for the connection between the armature and actuator. The side wall 71 of the actuator continues in a circumferential wall 72 and forms therewith a circumferential trough 73 open upwards and partly surrounding the magnet system. Moreover, the actuator also forms towards the underside a circumferential wall 74 which thus forms a trough 75 open downwards which partly surrounds a contact system 8. Both troughs 75 and 73 are mutually delimited by a common floor or a partition 76, as a result of which the contact system 8 is insulated from the coil and the yoke. The partition 76 extends essentially parallel to the coil axis and perpendicular to the armature 6. It thus forms the second limb of an angular armature unit formed from the armature 6 and the actuator 7. Owing to the circumferential side walls 72 and 74, the actuator is also sufficiently stiffened, so that it does not sag when actuated. Moreover, by comparison with the overall dimensions of the relay, the side walls 72 and 74 produce very long clearances in air and creepage distances between the contact system 8 and the coil 2, and also between the metallic parts of the magnetic circuit.

Figure 6:
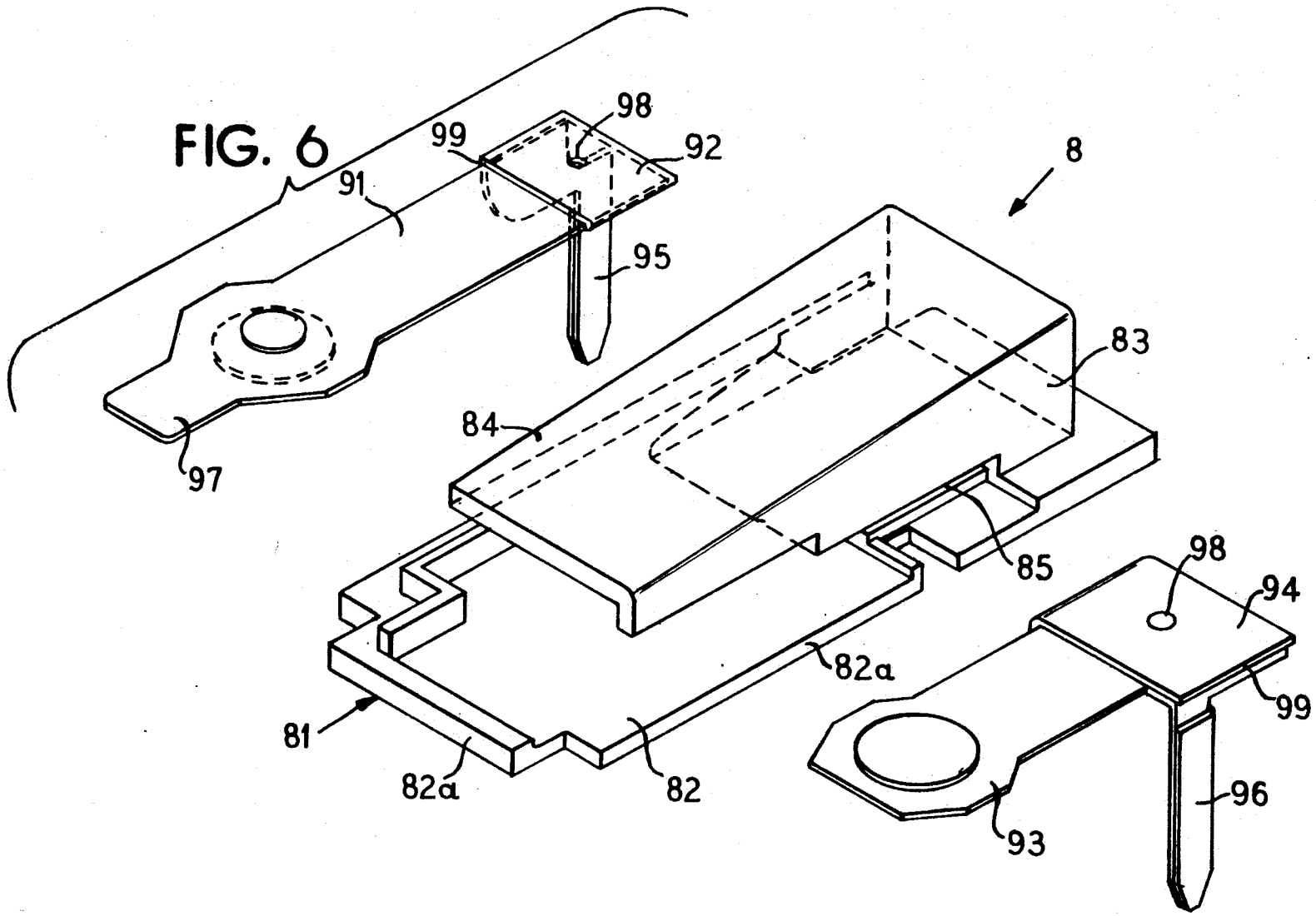
FIG. 6 shows the contact system of FIG. 1 in an exploded representation.

In the present case, the contact system is constructed on an insulating carrier 81 which consists in one piece of a plate-shaped base part 82, a mounting block 83 and a lid part 84. Receptor slots 85 are formed from both sides in each case in the mounting block 83 (only one side being visible in FIG. 6), into which a contact spring 91 with a folded mounting part 92 and a mating contact spring 93 with a folded mounting part 94 are plugged. Each of the contact elements 91 and 93 has a terminal pin 95 and 96 respectively, formed by folding the spring sheet-metal. Owing to the folding, the mounting part 92 or 94 acquires in each case the thickness and stability required for plug-in mounting, it being possible for the superimposed sections also to be connected by a weld 98, if required.

Moreover, in each case the bent-over section forms a projecting edge 99 to which an assembly tool can be applied to press the respective contact element 91 or 93 into the carrier 81.

Figure 1:
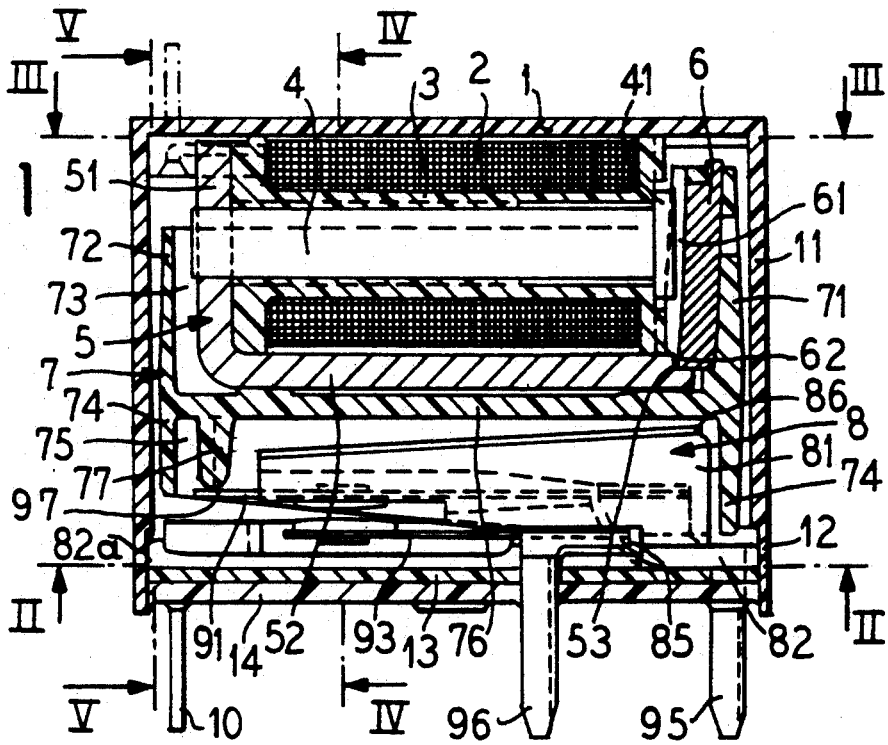
FIG. 1 shows a longitudinal section of a relay configured according to the invention.
Figure 3:
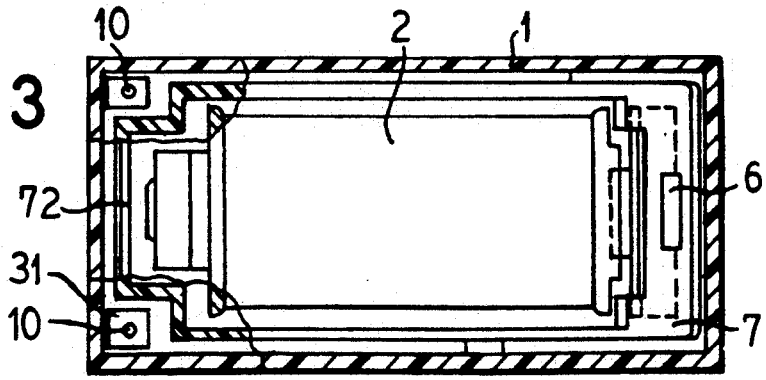
Figure 4:
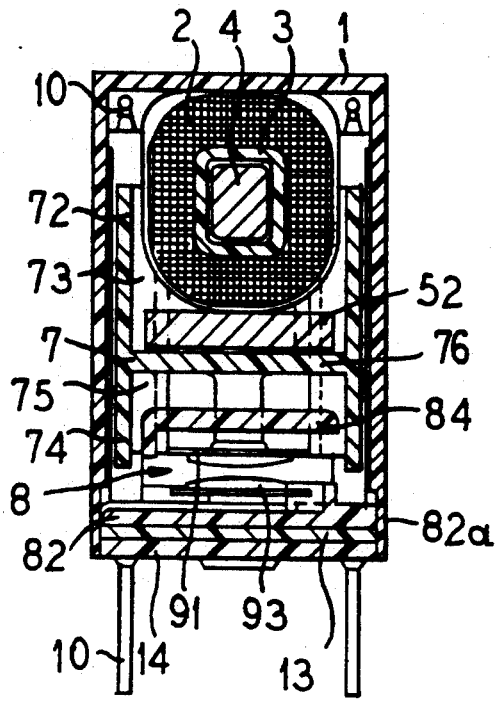
Figure 5:
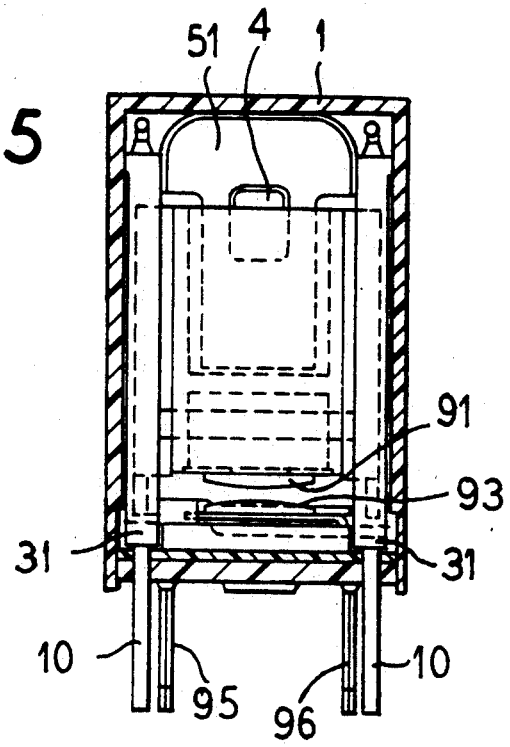

The contact spring 91 can move freely outside its clamping point. At its free end 97, it is actuated via an actuating nipple stud 77 of the actuator 7 in accordance with the switching movement of the armature. The lid part 84 of the carrier 81 forms an additional insulating wall between the contact system and the magnet system, only the free end 97 of the contact spring 91 projecting for the purpose of actuation. Insofar as a third insulating layer is required in addition to the partition 76 and the lid part 84, an additional foil 86 can be laid or glued on the latter, as is indicated in FIG. 1, but not shown in FIG. 6.

If for functional reasons, the lid part 84 must be embodied smaller, it is expedient to apply one or more foils to the partition 76. It is also possible to configure the partition 76 by means of gaps in such a way that at least three insulating walls are produced.

Instead of the make contact shown in the example, it is, of course, also possible to use a different, arbitrary, set of springs in the relay, for example, a break contact, a change-over switch, or even a set of springs with a plurality of units.

In assembling the relay, the first step is to mount the complete armature unit consisting of the armature 6 and the actuator 7 on the magnet system, a bearing blade 62 integrally formed on the armature being inserted into a bearing notch 53 of the yoke. This magnet system thus completed is then inserted into the housing 1, the coil consisting of the winding 2 and coil former 3 preferably being glued fast or clamped in the closed end part of the housing 1. The armature unit is thus ensured against falling out by the side wall 11 of the housing 1.

The contact system 8 is then inserted into the open side of the housing 1, the stepped edge zone 12 of the housing forming a linear bearing for the base 82 of the contact system. The outer edge 82*a* of this base 82 is largely adapted to the contour of the housing edge 12; however, it has a few cutouts for the penetration of the contact terminal pins 95 and 96 and the insulating sheathing 31 of the coil terminal pins 10. On insertion, the base 82 is not guided against a stop of the housing but, when the magnet system is excited, is inserted until the contact spring 91 is actuated by the nipple stud 77 and the contact is closed by the mating contact element 93. Thereafter, the excitation of the relay is switched off so that the contact opens. The contact system 8 is now additionally inserted by a prescribed amount by means of which a specific erosion resistance of the contacts is guaranteed. Thereafter, the contact system, that is to say the base 82, is fixed with respect to the housing, and this can be performed by means of a quick-acting glue, for example.

A cover plate 13 is pushed over the terminal pins 95, 96 and 10 in order to seal the remaining openings in the floor. A casting compound 14 is then introduced from outside in the space formed by the cover plate 13 and the housing edge 12, sealing of the housing thereby being completed. Of course, it is possible in this case to provide in a conventional way in the housing a ventilation hole which is opened during or else after the sealing, and later sealed.

Although other modifications and changes may be suggested by those skilled in the art, it is the intention of the inventor to embody within the patent warranted hereon all changes and modifications as reasonably and properly come within the scope of his contribution to the art.

I claim:

1. An electromagnetic relay comprising:

a cap-shaped housing open towards a terminal end of the relay, said cap-shaped housing having a guideway, a magnet system with a coil and an armature arranged in an upper, closed zone of the housing, and a contact system arranged in a lower, open zone of the housing, said contact system including a carrier of insulating material, at least one moveable contact element in said carrier, an actuator operationally connecting said at least one moveable contact element to the armature, the carrier at least partly closing an open side of the housing from below, wherein each moveable contact element extends essentially parallel to a terminal plane of said relay and is actuatable in a direction perpendicular thereto, the magnet system being anchored directly in the housing and the carrier of the contact system being guided in said guideway of the housing parallel to an actuating direction of said at least one moveable contact element without a stop and connected to the housing in a freely settable insertion position.

2. An electromagnetic relay as claimed in claim 1, wherein the carrier has an essentially plate-shaped base part with a circumferential guide edge, and a mounting block on the base part for contact springs that are plugged laterally into receptor slots.

3. An electromagnetic relay as claimed in claim 1, wherein towards the magnet system the carrier has an insulating wall which shields the contact elements with the exception of a penetration point for the actuator.

4. An electromagnetic relay as claimed in claim 1, wherein the guideway for the magnet system is a stepped edge zone of the housing.

5. A process for assembling a relay comprising the steps of:

anchoring a magnet system to the actuator in a housing, inserting a contact system is then into the housing until a contact is closed when the magnet system is excited, and connecting a carrier of the contact system to the housing.

6. A process as claimed in claim 5, wherein after the closure of the contacts inserting the contact system further by a prescribed amount and only then connecting the contact system to the housing.

* * * * *